US005260512A

United States Patent [19]

Chomette et al.

[11] Patent Number: 5,260,512

[45] Date of Patent: Nov. 9, 1993

[54] SOUND-SIGNAL GENERATOR HAVING BALL-SHAPED HOUSING WITH KEYBOARD INCORPORATED THEREIN

[75] Inventors: Michel Chomette, La Colle Sur Loup; Robert J. Mathews, St. Laurent-du-Var; Remond Sautreau, Villeneuve Loubet, all of France

[73] Assignee: Texas Instruments Incorporated, Dallas, Tex.

[21] Appl. No.: 870,723

[22] Filed: Apr. 13, 1992

Related U.S. Application Data

[63] Continuation of Ser. No. 634,899, Dec. 27, 1990, abandoned.

[30] Foreign Application Priority Data

Dec. 29, 1989 [FR] France ..... 89 17487

[51] Int. Cl.[5] ..... G10H 1/32; G10H 5/00; A63B 41/00

[52] U.S. Cl. ..... 84/644; 84/670; 84/719; 84/DIG. 7; 273/58 G; 273/65 EF; 273/58 E; 446/302; 446/409; 446/397; 446/484

[58] Field of Search ..... 84/600, 644, 670, 718, 84/743, DIG. 7, DIG. 17, 94.1, 94.2, 95.1, 95.2; 273/58 E, 58 G, 65 EF, 58 R; 446/143, 299, 302, 409, 719, 720, 744, 745, 397, 484

[56] References Cited

U.S. PATENT DOCUMENTS

| | | | |
|---|---|---|---|
| 4,440,400 | 4/1984 | Neuberger | 273/586 X |
| 4,551,114 | 5/1985 | Hyman et al. | 446/397 |
| 4,577,865 | 3/1986 | Shishida | 273/58 G |
| 4,662,260 | 5/1987 | Rumsey | 84/DIG. 7 |
| 4,706,536 | 11/1987 | Sanders | 84/423 R X |
| 4,836,075 | 6/1989 | Armstrong | 84/DIG. 7 |
| 4,872,854 | 10/1989 | Hseu | 273/58 G X |
| 5,049,107 | 9/1991 | De Nittis | 446/397 |
| 5,070,755 | 12/1991 | Carroll | 84/600 |

FOREIGN PATENT DOCUMENTS

| | | |
|---|---|---|
| 2208028 | 2/1989 | United Kingdom . |
| 2214832 | 9/1989 | United Kingdom . |

*Primary Examiner*—William M. Shoop, Jr.
*Assistant Examiner*—Jeffrey W. Donels
*Attorney, Agent, or Firm*—William E. Hiller; Richard Donaldson; Jay M. Cantor

[57] ABSTRACT

Sound signal generator, comprising a housing (1,2) containing a microcontroller for the storage and control of reproduction of several sound messages, and a loudspeaker for reproducing the said sound messages connected to the in lieu thereof microcontroller. The housing of the sound-signal generator also carries, over at least a portion of its outer wall, a keyboard associated with the microcontroller and formed by selection keys (3) respectively bearing identification symbols for the sound messages stored in the microcontroller.

28 Claims, 5 Drawing Sheets

FIG_7
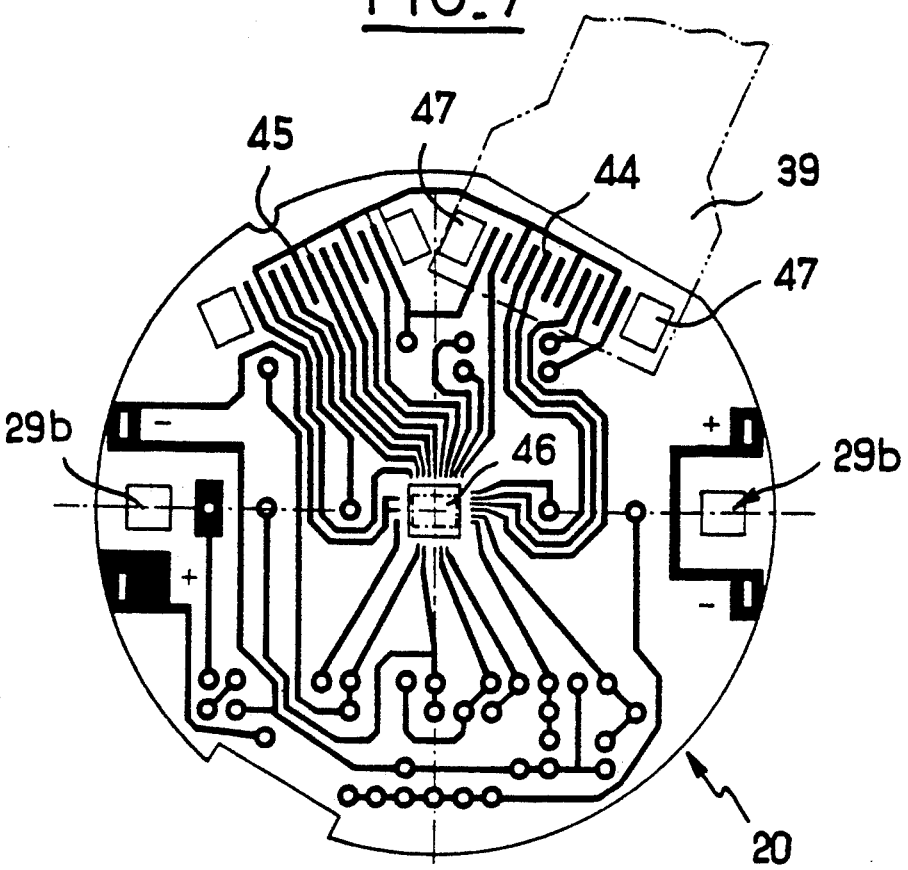
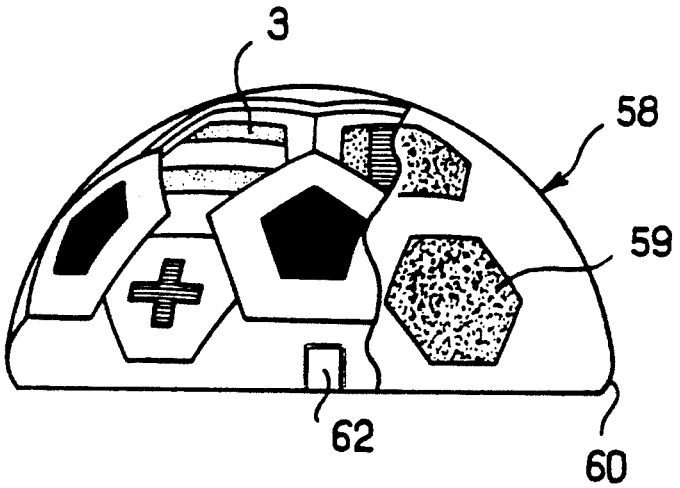
FIG_8

SOUND-SIGNAL GENERATOR HAVING BALL-SHAPED HOUSING WITH KEYBOARD INCORPORATED THEREIN

This application is a continuation of application Ser. No. 634,899, filed Dec. 27, 1990 now abandoned.

The present invention relates to sound-signal generating devices.

It is aimed at providing a generator of sound messages, especially musical messages, which, whilst having relatively small volume, makes it possible to produce several sound messages under the control of selection keys.

Its subject is, therefore, a sound-signal generator, characterised in that it comprises a housing containing electronic means for the storage and control of reproduction of several sound messages, and means for reproducing the said sound messages connected to the said means for storage and control of reproduction, and in that the said housing also carries, over at least a portion of its outer wall, a keyboard associated with the means for storage and control of reproduction and formed by selection keys respectively bearing identification symbols for the sound messages stored in the said means for storage and control of reproduction.

According to a particular characteristic of the invention, the means for storage and control of reproduction and the means for reproducing the sound messages are connected to an independent supply source contained in the housing.

BRIEF DESCRIPTION OF THE DRAWINGS

The invention will be understood better from the following description, given purely by way of example and made with reference to the accompanying drawings in which:

FIG. 7 is a plan view on a larger scale of a printed-circuit board involved in the construction of the sound-message generator according to the invention;

FIG. 8 shows the outer casing of one shell of the housing of the sound-message generator according to the invention.

Figure 1:
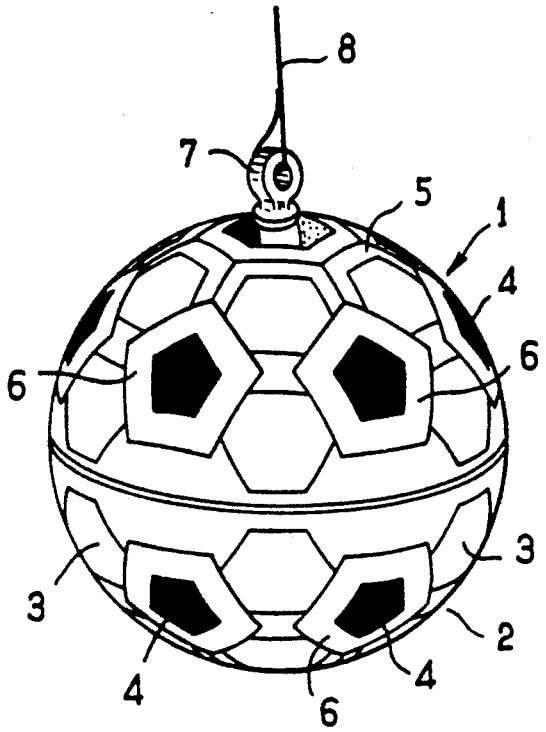
FIG. 1 is an outer elevation view of a preferred embodiment of a sound-message generator of spherical shape similar to a miniaturized soccer ball.

The sound-message generator which will now be described with reference to the drawings takes the form of a sphere representing a miniature soccer ball.

The sound-message generator comprises two hemispherical parts or domes 1 and 2 associated with one another in a way which will be described later. Each of the two shells 1,2 carries, on its outer surface, a casing made of thermoformed material, on which are represented the images 3 of panels which, when assembled, form the casing of the soccer ball.

In the present example, each of the casings of the domes 1 and 2 carries parallel rows of images 3 of hexagonal shape and a row of images 4 of pentagonal shape. The various images are mostly separated from one another by means of margins 5,6.

In the present embodiment, the images 3 of hexagonal shape each carry a representation of the flag of one of the countries qualifying for a competition on the occasion of which the sound-message generator is to be distributed.

This is, for example, an event such as the World Cup football (i.e. soccer) competition.

In the present example, the pentagonal images 4 are black in colour because they are not used.

However, it is possible to consider using them to show, for example, information of the advertising type or the like.

As will emerge more clearly from the following, the hexagonal zones 3 of the two shells 1 and 2 constitute the keys of a control keyboard of the device. It is also possible to consider using the pentagonal zones 4 as keys.

The separating margins 5,6 between the images 3,4 serve for inscribing the name of the country opposite the flag of this country.

Moreover, the housing is equipped with a suspension member 7 consisting of a lug fastened to the shell 1 of the housing and intended for receiving a suspension cord 8.

Figure 2:
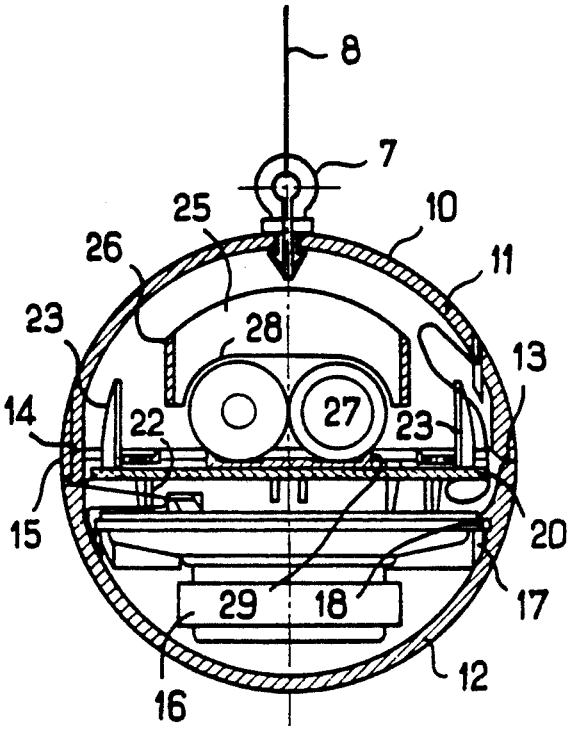
FIG. 2 is a view in vertical section of the generator of FIG. 1, showing the layout of the various members of the generator inside its housing.

As can be seen in FIG. 2, the housing of the sound-signal generator according to the invention, formed from the two domes 1 and 2, comprises a rigid inner casing 10, for example made of polypropylene, intended for containing the electronic circuit and the supply source of the device.

The casing 10 consists of two domes 11 and 12 articulated relative to one another by means of an integrally produced hinge 13.

Opposite the hinge 13, one of the domes 11 has an aperture 14 for receiving a closing hook 15 provided on the other dome 12.

The chamber defined by the two assembled domes contains a loudspeaker 16 held in place in the dome 12 by means of an annular shoulder 17 moulded integrally with the dome 12 and by means of fastening hooks 18 uniformly distributed on the periphery of the dome 12.

The hooks 18 are likewise produced integrally with the dome 12. They are arranged in slots 19 of the said dome.

Figure 3:
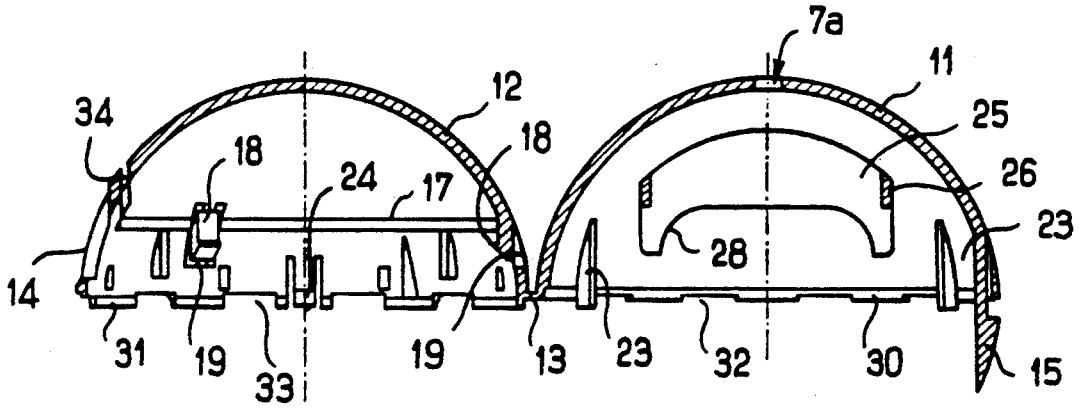
FIG. 3 is a cross-sectional view of the opened spherical housing, the members which it contains being removed.

The members for retaining the loudspeaker 16 are shown clearly in FIG. 3.

The chamber delimited by the two domes of the housing of the device contains, furthermore, a printed-circuit board which carries all the electronic circuits involved in the construction of the device. This printed-circuit board bears the general reference 20. It is supported in the dome 12 by projections 22 and is laid against these projections during the closing of the housing by means of complementary projections 23 produced integrally with the dome 11. Moreover, the printed circuit 20 is immobilised by means of diametrically opposed hooks 24 produced integrally with the dome 12.

Made in the dome 11 are four ribs 25,26 produced integrally with the said dome and forming a cradle of rectangular shape intended for holding supply batteries 27 of the device.

For this purpose, two of the ribs 25 arranged perpendicularly relative to the batteries have a curved profile 28 matched to the shape of the batteries and enabling them to be received. The other ribs 26 extend parallel to the batteries 27 and form reinforcing elements. Between the batteries 27 and the printed circuit 20 is arranged a support 29 which is laid against the printed circuit 20 by means of fastening tabs 29*a* of the support 29 which are engaged in orifices 29*b* made in the printed circuit 20.

Figure 2A:
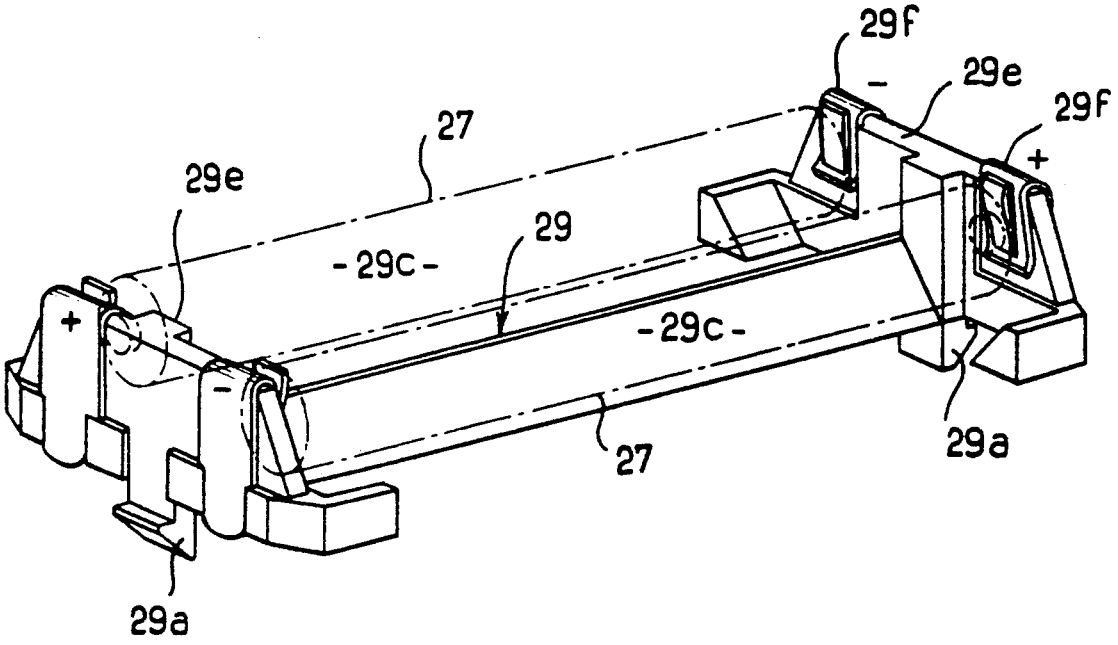
FIG. 2A is a perspective view of a support for supply batteries of the generator.

As shown in FIG. 2A, the support 29 is equipped with its fastening tabs 29*a* carrying outwardly-turned hooks at their ends and with two lateral locations 29*c* for the batteries 27, extending on either side of a web 29*d* terminating at its ends in crosspieces 29*e* carrying stirrup-shaped electrical contacts 29*f* and the fastening hooks 29*a*.

The orifices 29*b* for receiving the hooks 29*a* of the support 29 are shown in FIG. 7.

The batteries 27 are held on the support 29 by means of the ribs during the closing of the housing and its locking by means of the hook 15.

Formed at the top of the dome 11 is an orifice 7*a*, in which the suspension member 7 of the device is engaged, as shown in FIG. 2.

The two domes 11 and 12 are respectively equipped with complementary centering rims 30 and 31 extending on their periphery and provided with respective notches 32, 33 intended, during the closing of the housing, to form louvers for the passage of the sounds emitted by the loudspeaker 16 under the control of the electronic circuit carried by the printed-circuit board.

Finally, in each of the domes 11 and 12 is made a slit, such as 34, intended, as will be seen later, for the passage of a printed strip carrying conductors for connecting the electronic circuit of the device to the control keyboard of the latter.

Figure 4:
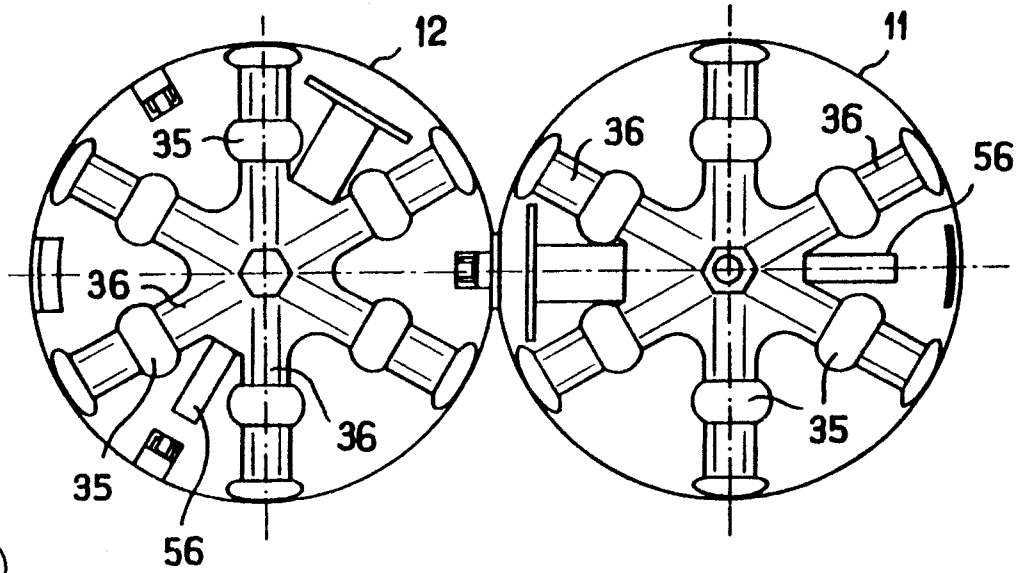
FIG. 4 is a top view of the housing of FIG. 3.

FIG. 4 shows a top view of the rigid casing of the housing of the sound-message generator according to the invention, the said housing being in an open position corresponding to that illustrated in FIG. 3.

Formed on each of the domes 11, 12 of the housing along meridians of each dome are flats 35 which constitute locations of keys of the keyboard of the generator. The flats 35 are connected to one another by means of grooves 36 of very small depth which are themselves arranged over large circles of the domes 11 and 12.

They consequently converge at the top of these shells.

Figure 5:
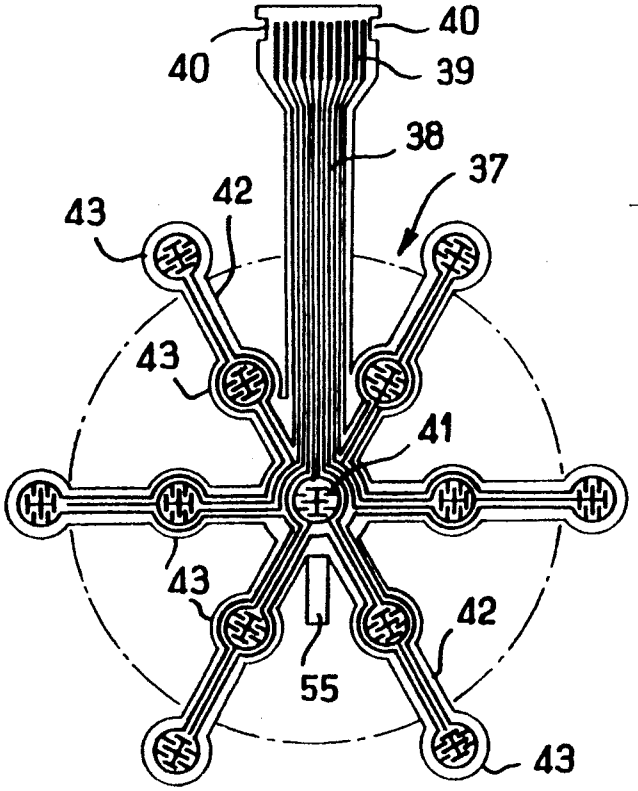
FIG. 5 is a plan view of a printed strip involved in the construction of the keyboard of the generator according to the invention.

The flats 35 and the grooves 36 joining them form a supporting assembly for a branched strip of printed conductors, such as that shown in FIG. 5.

As can be seen in FIG. 5, this strip bearing the general reference 37 comprises a common trunk 38 formed from several parallel conductors insulated from one another and terminating in a connection end 39 equipped with lateral notches 40 for positioning relative to corresponding orifices 47 made in the printed circuit 20. The branched strip 37 also possesses a central node 41, from which extend branches 42 intended to take their place in the corresponding superficial grooves 36 of each of the domes 11, 12, each branch having contact zones 43 arranged at distances corresponding to the distances between the flats 35 formed on the domes 11 and 12. In each of the contact zones 43 there are two conductors insulated from one another and intended to be short-circuited by an associated movable contact, which will be described later.

The connection end of the trunk 38 is introduced into the chamber defined by the two domes 11, 12 through the slits, such as 34, in order to be connected to the printed circuit 20 in a way which will be described with reference to FIG. 6.

A strip of the type described with reference to FIG. 5 is fastened to each of the domes 11 and 12, and the end of its common trunk is connected to the printed-circuit board 20.

FIG. 7 shows the printed face of the board 20.

As can be seen from FIG. 7, the printed-circuit board 20 comprises two series of connecting conductors 44, 45, to each of which is to be connected a connection end 39 of each of the branched strips of printed conductors 37.

The series of conductors 44 and 45 are connected to a microcontroller 46 containing in its memory the sound messages which the generator must produce and, like the other components of the circuit, carried on the face of the board 20 opposite its printed conductors. The printed-circuit board 20 is of general circular shape. The sets of conductors 44 and 45 are arranged with an angular offset of approximately 60°. Each of the sets 44 and 45 is bounded on either side by rectangular orifices 47, with which are to interact arms 48 equipped with hooks 49 of a clip 50 for connecting each of the sets of conductors 44, 45 to a connection end 39, represented by dot-dashed lines in FIG. 7, of an associated branched strip of the printed conductors 37.

Figure 6:
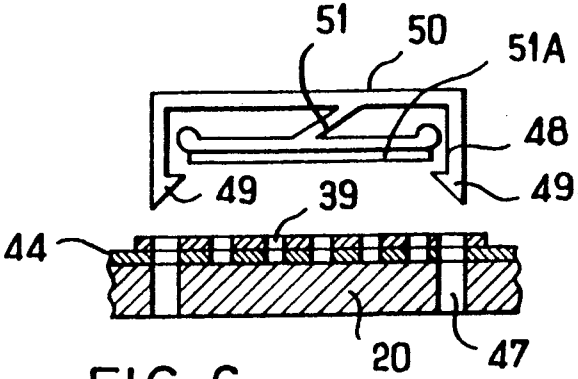
FIG. 6 shows the means for connecting a printed strip to the electronic circuit contained in the housing.

As shown in FIG. 6, the connection between a branched strip 37 and one of the sets 44 of conductors of the printed circuit 20 is made by first superposing the conductors of the connection end 39 relative to the conductors of the set of conductors 44, the notches 40 of the connection end 39 being placed opposite the orifices 47 of the printed-circuit board. Subsequently, the arms 48 of the clip 50 are engaged in the orifices 47 and at the same time ensure that the connection end 39 is immobilised relative to the set of conductors 44. The clip 50 has an elastic pad 51 which is arranged between its arms 48 and which, when the hooks 49 of the arms 48 of the clip are engaged behind the face of the board 20 opposite the printed set 44, firmly lays the connection end 39 of the strip 37 against the conductor set 44 and ensures the assembly and therefore electrical connection of the conductors of these two sets to one another. A foam strip 51*a* fastened to the pad 51 ensures a uniform pressure of the connection end 39 on each of the sets of conductors 44 and 45.

The branched strips of printed conductors 37 have an adhesive face and are fastened to the corresponding domes 11, 12 by the bonding of their adhesive face in the grooves 36 and on the flats 35 of the outer surfaces of the domes 11 and 12. The positioning of each of the branched strips is also made easier by the presence on each of the strips of a positioning tab 55 which, when the branched strip is put in place, is arranged in a corresponding positioning groove 56 made on the outer surface of each of the domes 11, 12.

A flexible outer casing 58, such as that shown in FIG. 8, is associated with each of the rigid domes 11 and 12 equipped with its branched strip of printed conductors 37. This casing of hemispherical shape carries, on its outer surface, drawings obtained by screen printing and forming the keys 3 and 4 described with reference to FIG. 1.

As already described above, each of the hexagonal keys 3 carries the image of a flag of a country participating in an international competition, particularly a soccer competition. On the inner face, opposite each of the hexagonal keys 3, the outer casing 58 has a conductive surface 59 which, when laid against one of the contact zones 43 of the branched printed strip 37 on which the flexible casing 58 is placed, is intended for making a contact of low electrical resistance between the two conductors terminating at the corresponding zone 43 and thus causing the control of the microcontroller 46, so as to cause it to produce the signals necessary for generating the desired sound message, in this particular case the national anthem of the nation represented by its flag appearing on the key actuated.

Of course, the keys of the keyboard thus formed can carry representations of any other kind, corresponding, for example, to advertising messages stored in the microcontroller.

It is also possible to represent on each of the keys the image of a children's song, the theme of which would be stored in the microcontroller and would be reproduced during the actuation of the corresponding key.

The flexibility of the material of the outer casing 58 makes it possible, by exerting pressure on one of the flags representing a nation appearing on the keys 3, to cause the conductive zone 59 made, for example, of carbon/silver to be put in contact with the contact zone 43 of the corresponding branched conductor strip 37 and thereby to control the production by the microcontroller of the appropriate sound message, that is to say the national anthem of the country identified by its flag.

The fact that the branched strip of printed conductors 37 is laid firmly by adhesive bonding on the flats 35 and in the grooves 36 (FIG. 4) of the hemispherical domes 11, 12 makes it possible to ensure that the flexible outer casing 58 is normally kept out of contact with the contact zones 43 of the printed conductor strip.

Referring once again to FIG. 8, it can be seen that each flexible casing 58 possesses an inwardly curved rim 60 which makes it possible to snap the casing onto each equatorial groove defined by the centering rim 30, 31 of each of the domes 11, 12, each flexible envelope 58 having a positioning reference 62 making it possible to arrange the images of the flags of the various nations exactly opposite the contact zones 43 of the branched strip of printed conductors intended for controlling the generation of the corresponding national anthem. The positioning reference 62 is intended for covering the junction hinge 13 of the two domes 11, 12 of the generator casing. The flexible casings 58 are fastened to the corresponding rigid domes 11, 12 by means of the double-face adhesive portions which make it possible to ensure the permanent fastening of the said outer casings after their positioning and engagement on the rigid domes as a result of the snapping of their equatorial rims 60.

The finished housing thus also constitutes the control keyboard of the sound-signal generator according to the invention.

The outer casings, after being fastened to the rigid domes, leave exposed the louvers formed by the notches 32, 33 and make it possible for the sounds emitted by the generator to come out of the housing.

In the present example, the surface on which the keyboard is provided is a spherical surface, that is to say non-planar, thus increasing the difficulty of producing the keyboard. In particular, the images which are to be found on the keyboard and which constitute the keys of the latter must, in order to appear uniformly on the hemispherical casings, first be traced flat in a predeformed manner as a function of the laws of deformation of the material of the flexible casing, so that the desired result is obtained after thermoforming.

Of course, it is also possible to produce a keyboard on surfaces other than spherical. These surfaces of different types can likewise be non-planar surfaces. These can be, for example, of oval or other shape.

It is also possible to produce housings with plane faces, at least some of which would carry keyboards formed in the way described with reference to FIGS. 1 to 6.

In the example just described, the keyboard consists of a rigid casing which is formed from the domes 11 and 12 and on which are laid branched printed conductors, the keyboard as a whole being completed by an outer flexible casing associated with each dome and carrying, on its inner face, conductive zones making the connection when the pressure of a finger is exerted on a zone of the corresponding outer surface of the casing.

It is also possible to fasten the band of printed conductors directly inside the flexible casing by initially forming a stack of a first sheet carrying the images on one face and the carbon/silver contacts on the other face, of a second layer of ink with microballs deformable under finger pressure, and of a third layer or strip carrying the conductors, the assembly as a whole subsequently being formed by thermoforming to obtain a keyboard assembly incorporated directly in the flexible casing.

In this instance, the rigid casing need have neither flats nor grooves.

The electronic circuit involved in the construction of the sound-message generator according to the invention will now be described with reference to FIG. 9.

Figure 9:
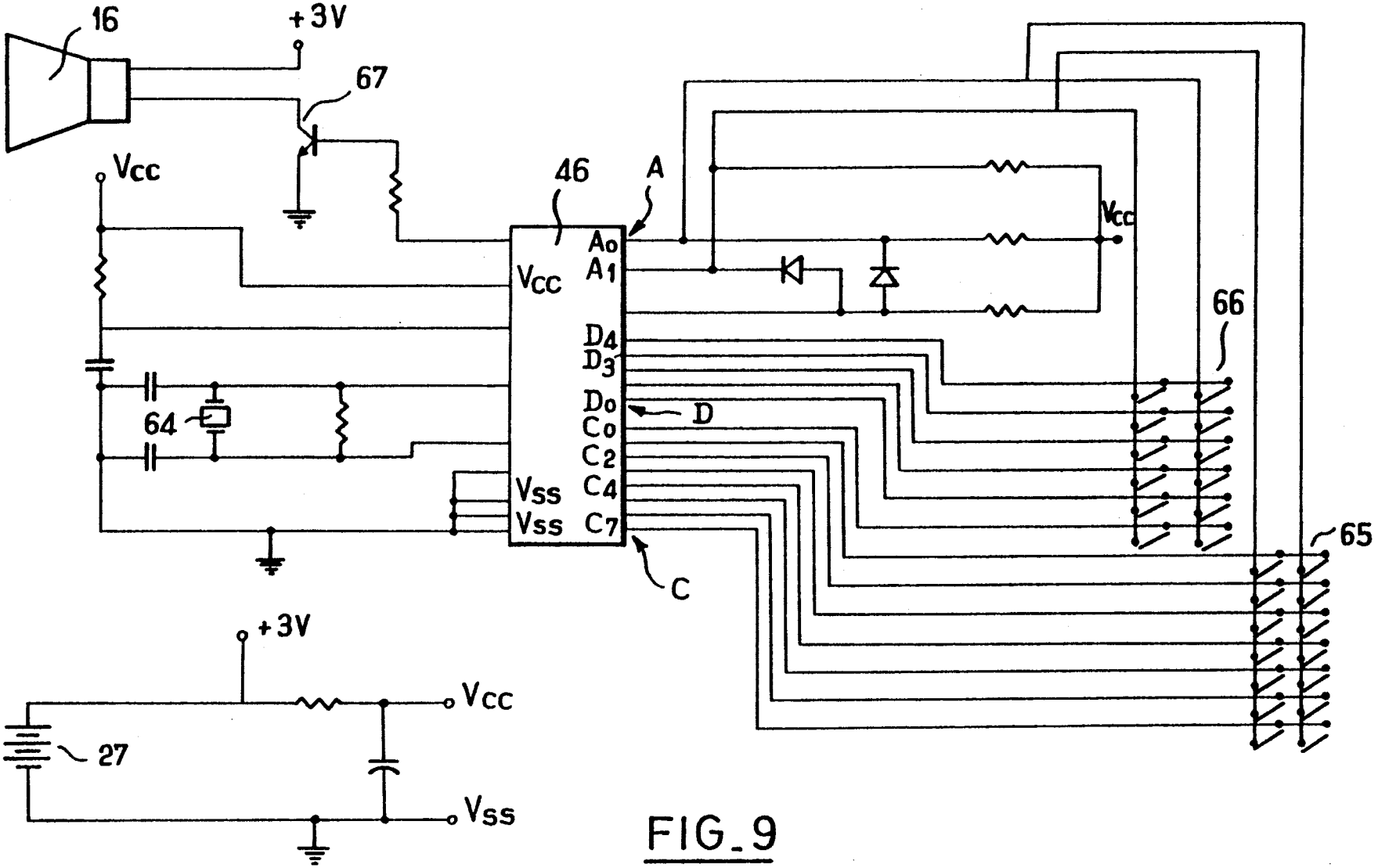
FIG. 9 is an electrical diagram of the sound-message generator according to the invention.

The circuit illustrated in FIG. 9 mainly comprises the microcontroller 46 already shown on the printed-circuit board of FIG. 7. This microcontroller is advantageously of the type 7OC40 manufactured and sold by the company, TEXAS INSTRUMENTS Incorporated of Dallas, Tex. It is preprogrammed to contain in its memory the data relating to the sound messages to be produced, and it is controlled by a ceramic resonator 64 constituting the master clock of the device. The branched strips of printed conductors, such as the strip 37 shown in FIG. 5, are connected by means of printed conductors on the board 20 to the input/output terminals of the microcontroller which are represented by the gates C and D.

The input/output terminals formed by the gate A are likewise connected, by means of printed conductors provided on the board 20, to other conductors of the branched strips of printed conductors, such as 37.

The gate C is mainly assigned to the upper hemisphere of the device, while the gate D is assigned to the lower hemisphere of the latter.

Two conductors of the gate A are respectively associated with the conductors of the gates C and D. At the intersection of the conductors of gate C and of the conductors of gate A are arranged switches 65 which are embodied on the casing of the generator according to the invention by the contact zones 43 of the corresponding branched strip of printed conductors 37, with which are associated the conductive zones 59 of the flexible casing 58 associated with the rigid dome 11.

Likewise, at the intersection of the conductors of gate D with the corresponding conductors of gate A are arranged switches 66 embodied by the contact zones 43 of the associated branched strip of printed conductors 37, arranged on the lower dome 12, and the conductive zones 59 of the flexible casing covering this lower dome.

The electronic circuit of FIG. 9 possesses, furthermore, an output transistor 67, the base of which is connected to the output B of the microcontroller 46 and the emitter/collector stage of which is connected between the loudspeaker 16 and around.

In the embodiment under consideration, during the selection of a sound message determined by actuating one of the switches 65 or 66, the microcontroller 46 emits trains of rectangular signals and the loudspeaker ensures the filtering of these signals to supply the corresponding sound message.

The message transmission time is determined by the clock signal emitted by the ceramic resonator 64 and by the execution of the program of the microcontroller.

It will also be appreciated that the microcontroller can be replaced by a sound synthesizer.

In the embodiment just described, the sound-message generator is a generator of musical melodies which are the anthems of the countries whose flags are represented on the keys of the keyboard formed on the generator housing.

However, it will be appreciated that this device can have the most diverse uses, without going beyond the scope of the invention.

Moreover, although in the present example, the keyboard of the sound generator is provided on the two domes of its housing, this keyboard can extend over only one dome or over only part of a dome.

We claim:

1. A sound-signal generator comprising:

a segmental housing, said segmental housing including first and second domes of relatively rigid material;

electronic means for storing and controlling the reproduction of a plurality of sound messages disposed within said housing;

means for reproducing said sound messages disposed within said housing and connected to said electronic means;

a keyboard disposed over at least a portion of at least one of said first and second domes of said housing and including a plurality of independently operable selection keys;

said keyboard being operably connected to said electronic means;

individual keys of said keyboard respectively having indicia thereon related to a particular sound message of said plurality of sound messages stored in said electronic means; and a particular sound message of said plurality of sound messages being provided by said electronic means to said reproducing means which generates the particular sound message as an audible output in response to the selective actuation of one of said plurality of keys included in said keyboard.

2. A sound-signal generator as set forth in claim 1, wherein said first and second domes are hemispherical in shape such that said housing is spherical.

3. A sound-signal generator as set forth in claim 1, further including means for connecting said first and second domes together for closing said housing and defining a chamber therein in which said electronic means and said reproducing means are disposed.

4. A sound-signal generator as set forth in claim 1, further including first and second flexible casings arranged on said first and second domes respectively and of complementary form with respect thereto;

said plurality of keys of said keyboard being provided on the outer surface of at least one of sad first and second flexible casings and having different images thereon providing the indicia for said plurality of keys of said keyboard;

a plurality of conductors disposed on the outer surface of at least one of said first and second domes corresponding to said at least one of said first and second flexible casings on the outer surface of which are said plurality of keys of said keyboard;

said plurality of conductors being connected to said electronic means and having a plurality of contact zones arranged in spaced relationship with respect to each other but in electrical connection to said electronic means;

the inner surface of said at least one of said first and second flexible casings being provided with a plurality of conductive zones respectively corresponding to the images of said plurality of keys; and said conductive zones on said at least one of said first and second flexible casings being disposed in opposing relation to respective key-forming images for providing an electrical connection between a contact zone of said plurality of conductors and a conductive zone on the inner surface of said at least one of said first and second flexible casings upon depression of a selected key-forming image for obtaining the selection of the sound message to be generated.

5. A sound-signal generator as set forth in claim 3, wherein each of said first and second domes has a respective centering rim internally of said housing and mutually complementary with respect to the other centering rim, said centering rims being positioned for respective abutment with each other when said first and second domes of said housing are disposed in a closed position.

6. A sound-signal generator as set forth in claim 5, wherein said centering rims have notches respectively defined therein and are disposed in mating relationship when said first and second domes of said housing are disposed in assembled relationship for closing said housing so as to define a plurality of louvers at the junction between said mutually complementary centering rims of said first and second domes to enable the sound messages as generated by said reproducing means to pass therethrough.

7. A sound-signal generator as set forth in claim 6, further including a printed circuit board disposed in said housing;

said electronic means being provided on said printed circuit board.

8. A sound-signal generator as set forth in claim 3, wherein said means for connecting said first and second domes together comprises a hinge integral with said first and second domes and connecting said first and second domes of said housing in relation to each other for enabling said first and second domes to be moveable between positions opening and closing said housing.

9. A sound-signal generator as set forth in claim 3, wherein said means for reproducing said plurality of sound messages comprises a loudspeaker disposed within said housing; and means within one of said first and second domes for retaining said loudspeaker in place within the chamber as defined by said housing in closed position.

10. A sound-signal generator as set forth in claim 9, wherein said means for retaining said loudspeaker within the chamber of said housing includes an annular shoulder formed within said first dome of said housing; and a plurality of fastening hooks arranged about the internal periphery of said annular shoulder and releasably attached to said loudspeaker for retaining said loudspeaker in place.

11. A sound-signal generator as set forth in claim 7, wherein said first dome of said housing further includes a plurality of inwardly extending projections for retaining said printed circuit board thereon; and a plurality of inwardly extending hooks provided in said first dome of said housing and secured to said printed circuit board for retaining said printed circuit board in stationary relation within said first dome of said housing.

12. A sound-signal generator as set forth in claim 11, wherein said housing further includes a plurality of projections extending inwardly from said second dome and disposed in opposed spaced relationship with respect to said projections provided in said first dome; and said printed circuit board being interposed between said projections of said first and second domes of said housing and being disposed on the projections of said first dome when said housing is in a closed position.

13. A sound-signal generator as set forth in claim 12, wherein said housing further includes a plurality of ribs extending inwardly within said second dome and defining a cradle;

a support disposed on said printed circuit board and arranged in spaced relationship with respect to said cradle; and battery means mounted on said support and extending partially within said cradle so as to be retained in place thereby.

14. A sound-signal generator as set forth in claim 4, wherein at least one of said first and second domes of said housing is provided with a slot therethrough;

said plurality of conductors comprising a printed conductor strip having a plurality of branches including a connection branch and other branches on which said contact zones are provided; and said connection branch of said printed conductor strip extending through said slot in said at least one of said first and second domes of said housing and being connected within said housing to said electronic means.

15. A sound-signal generator as set forth in claim 14, wherein said at least one of said first and second domes of said housing has a plurality of flats arranged in spaced relationship on the outer surface thereof;

the outer surface of said at least one of said first and second domes being provided with a plurality of relatively shallow grooves forming a connecting network with respect to the plurality of flats and arranged along meridians of said at least one of said first and second domes;

said contact zones on said other branches of said printed conductor strip corresponding to said flats on the outer surface of said at least one of said first and second domes and being respectively received thereon;

said plurality of branches of said printed conductor strip being received within said shallow grooves; and said printed conductor strip being secured to the outer surface of said at least one of said first and second domes.

16. A sound-signal generator as set forth in claim 15, wherein said printed conductor strip further includes a positioning tab provided thereon; and the outer surface of said at least one of said first and second domes with which the said printed conductor strip is associated being provided with a positioning groove therein for receiving said positioning tab of said printed conductor strip.

17. A sound-signal generator as set forth in claim 15, further including a printed circuit board disposed in said housing;

said electronic means being provided on said printed circuit board;

said printed circuit board having a set of conductors thereon corresponding to said plurality of conductors of said connection branch of said printed conductor strip; and a connecting clip for securing said plurality of conductors of said connection branch of said printed conductor strip to the corresponding conductors of said set of conductors on said printed circuit board.

18. A sound-signal generator as set forth in claim 17, wherein said connecting clip includes elastic means for disposing the connection branch of said printed conductor strip against the conductors of said set of conductors on said printed circuit board;

said connection branch of said printed conductor strip and said printed circuit board respectively being provided with positioning means; and said connecting clip further including positioning means thereon complementary with respect to said positioning means of said connection branch of said printed conductor strip and said positioning means of said printed circuit board to retain said printed conductor strip in place with the connection branch thereof connected to said corresponding conductors of said set of conductors on the printed circuit board.

19. A sound-signal generator as set forth in claim 18, wherein said elastic means of said connecting clip comprises a pad having a foam strip mounted thereon to provide uniform pressure of the connection branch of said printed conductor strip on the corresponding conductors of said set of conductors on said printed circuit board;

said positioning means of said connecting clip comprising arms extending therefrom and having hooks on the ends thereof;

said positioning means of said printed circuit board being provided by orifices formed therein on opposite sides of the set of conductors on said printed circuit board for receiving said hooks of said connecting clip; and said positioning means formed in said connection branch of said printed conductor strip being provided by lateral notches formed in said connection branch for reception of the arms of said connecting clip so as to dispose said connection branch of said printed conductor strip between the arms of said connecting clip with said foam strip overlying said connection branch of said printed conductor strip.

20. A sound-signal generator as set forth in claim 1, wherein said electronic means for storing and controlling the reproduction of said plurality of sound messages comprises a microcontroller, and said means for reproducing said sound messages comprises a loudspeaker;

oscillator means connected to said microcontroller for driving said microcontroller;

the output of said microcontroller being connected to said loudspeaker;

plural switch means interposed between said microcontroller and said plurality of keys of said keyboard and respectively corresponding to each of said keys; and said microcontroller being provided with input/output terminals connected to said switch means and being selectively responsive to the actuation of a particular key closing the one of said plural switch means corresponding thereto for accessing the one of said plurality of sound messages corresponding to the selected key.

21. A sound-signal generator as set forth in claim 4, further including a layer provided with deformable microballs thereon interposed between the inner surface of said at least one of said first and second flexible casings and said contact zones of said plurality of conductors facing the inner surface of said at least one of said first and second flexible casings.

22. A keyboard for an electronic device contained in a housing, said keyboard comprising:

a rigid support of ball-like shape forming at least part of a housing;

a flexible outer casing conforming to having an outer non-planar surface and said rigid support and secured thereto;

said flexible outer casing having a plurality of indicia on its outer surface and conductive zones corresponding to said plurality of indicia on its inner surface defining respective ones of a plurality of keys;

printed conductor means interposed between the flexible outer casing and said rigid support and including a plurality of branches of printed conductors;

a plurality of contact zones provided on said plurality of branches of said printed conductor means and corresponding to said plurality of conductive zones on the inner surface of said flexible outer casing;

said printed conductor means having an interconnecting branch of printed conductors for connection to the electronic device within said housing; and said contact zones on said plurality of branches of said printed conductor means being respectively disposed in opposed relation to corresponding ones of said plurality of conductive zones on the inner surface of said flexible outer casing;

each of said plurality of keys being selectively actuable in response to pressure being applied to a selected one of said indicia on the outer surface of said flexible outer casing causing a corresponding conductive zone to engage a contact zone on one of said plurality of branches of said printed conductor means.

23. A keyboard as set forth in claim 22, wherein the outer surface of said rigid support to which said flexible outer casing conforms is a non-planar surface.

24. A keyboard as set forth in claim 22, wherein the housing is spherical and comprises first and second rigid domes as respective rigid supports;

first and second flexible outer casings respectively corresponding to said first and second rigid domes and conforming thereto;

each of said first and second flexible outer casings being provided with said plurality of indicia and corresponding conductive zones on its outer and inner surface respectively defining said plurality of keys and secured to the one of said first and second rigid domes corresponding thereto; and said printed conductor means being disposed on the outer surface of said first and second rigid domes.

25. A keyboard as set forth in claim 24, wherein each of said first and second rigid domes is provided on its outer surface with a plurality of flats arranged in a spaced apart configuration and a plurality of relatively shallow grooves connecting the flats in a network arranged along meridians of the corresponding dome; and the plurality of contact zones of said printed conductor means being received by said flats and the plurality of branches of printed conductors of said printed conductor means being received in said shallow grooves on the outer surface of each dome.

26. A keyboard as set forth in claim 25, wherein said printed conductor means is provided with first and second positioning tabs; and the outer surface of each of said first and second domes having a positioning groove formed therein corresponding to the respective one of said first and second positioning tabs of said printed conductor means for receiving said respective one of said first and second positioning tabs.

27. A keyboard as set forth in claim 22, wherein said printed conductor means is fixed to said flexible outer casing; and a layer having deformable microballs provided thereon interposed between the inner surface of said flexible outer casing and the plurality of contact zones of said printed conductor means facing the inner surface of said flexible outer casing.

28. A keyboard as set forth in claim 27, wherein the surface of said rigid support with which said flexible outer casing is associated is a smooth outer surface.

* * * * *